US006400215B1

(12) United States Patent
Yamaguchi

(10) Patent No.: US 6,400,215 B1
(45) Date of Patent: Jun. 4, 2002

(54) MIRROR CIRCUIT

(75) Inventor: Akira Yamaguchi, Kitaadachi-gun (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/527,601

(22) Filed: Mar. 17, 2000

(30) Foreign Application Priority Data

Mar. 17, 1999 (JP) ..... 11-071608

(51) Int. Cl.[7] ..... G05F 1/10; G05F 3/02
(52) U.S. Cl. ..... 327/543; 323/315
(58) Field of Search ..... 327/538, 540, 327/541, 543; 323/312, 313, 315

(56) References Cited

U.S. PATENT DOCUMENTS 5,164,614 A * 11/1992 Maekawa ..... 327/537
5,332,928 A * 7/1994 Johnson ..... 327/538
5,939,933 A * 8/1999 Wang ..... 327/512
6,188,270 B1 * 2/2001 Boerstler ..... 327/543

FOREIGN PATENT DOCUMENTS

JP 5-108182 4/1993

* cited by examiner

*Primary Examiner*—Toan Tran
*Assistant Examiner*—Quan Tra
(74) *Attorney, Agent, or Firm*—Finnegan, Henderson, Farabow, Garrett & Dunner, L.L.P.

(57) ABSTRACT

A mirror circuit in which currents flow in the constant-current transistors, respectively, each constant current being proportional to the gate width of the transistor. The voltage applied to the gate of the first constant-current transistor has been generated by the first constant-voltage transistor located near the first constant-current transistor and orientated in the same direction as the first constant-current transistor. The voltage applied to the gate of the second constant-current transistor has been generated by the second constant-voltage transistor located near the second constant-current transistor and orientated in the same direction as the second constant-current transistor.

14 Claims, 3 Drawing Sheets

MIRROR CIRCUIT

CROSS-REFERENCE TO RELATED APPLICATION

This application is based upon and claims the benefit of priority from the prior Japanese Patent Application No. 11-071608, filed Mar. 17, 1999, the entire contents of which are incorporated herein by reference.

BACKGROUND OF THE INVENTION

The present invention relates to a mirror circuit in which currents flow in constant-current transistors, respectively, each constant current being proportional to the gate width of the transistor. More particularly, the invention relates to a mirror circuit for use in an analog circuit incorporating a plurality of transistors, each receiving a constant current and generating a constant current, or in a high-speed IF (Interface) circuit designed for small signals.

Mirror circuits are known as circuits in which constant currents flow in constant-current transistors, respectively, each constant current being proportional to the ratio of the gate width to the gate length (dimension ratio) of the transistor.

FIG. 1 shows such a conventional mirror circuit. The mirror circuit comprises a constant-voltage generating circuit 101 and a plurality of N-channel MOS transistors (constant-current transistors), e.g., three N-channel MOS transistors Tr.1, Tr.2 and Tr.3. The constant-voltage generating circuit 101 comprises N-channel MOS transistor Tr.0. The circuit 101 receives a constant current I0 from a constant current circuit 102 (or an external terminal, not shown) and generates a constant bias voltage (constant voltage Vref). The constant-current transistors Tr.1, Tr.2 and Tr.3 receive the output (i.e., constant voltage Vref) of the constant-voltage generating circuit 101. In each of the transistors Tr.1, Tr.2 and Tr.3, there flows a constant current that is proportional to the ratio of the gate width to the gate length (hereinafter referred to as "gate-width ratio"). The transistors Tr.0, Tr.1, Tr.2 and Tr.3 have different gate widths W0, W1, W2 and W3, respectively, and have the same gate length L0. Hence, constant current W1/W0×I0 flows in the constant-current transistor Tr.1, constant current W2/W0×I0 flows in the constant-current transistor Tr.2, and constant current W3/W0×I0 flows in the constant-current transistor Tr.3.

In the mirror circuit described above, it is necessary to orientate the transistors Tr.1, Tr.2 and Tr.3 in the same direction as shown in FIG. 2, so that a constant current proportional to the gate-width ratio may flow in each constant-current transistor. In other words, the source (S)-drain (D) paths of transistors Tr.0, Tr.1, Tr.2 and Tr.3 must be orientated in the same direction. If the source (S)-drain (D) paths of transistors Tr.0, Tr.1, Tr.2 and Tr.3 are orientated in different directions as is illustrated in FIG. 3, the matching of the transistors Tr.0, Tr.1, Tr.2 and Tr.3 will deteriorate. The deterioration of the matching (so-called "matching failure") results from the difference between the transistors Tr.0, Tr.1, Tr.2 and Tr.3 in terms of threshold value (Vth) or current value (constant current I0). This difference has been caused by the erroneous orientation of the wafer or the slantwise implantation of ions in the process of manufacturing the mirror circuit. Consequently, a constant current proportional to the gate-width ratio cannot flow in each of the constant-current transistors Tr.1, Tr.2 and Tr.3. Thus, the matching failure deteriorates the circuit characteristics or the circuit margin.

To prevent the deterioration of the circuit characteristics or the circuit margin, the conventional mirror circuits are designed to orientate the constant-current transistors in the same direction, as much as is possible. Here arises a problem. The trend in recent years is to incorporate a mirror circuit into high-speed IF circuits designed for small signals. In a high-speed IF circuit for small signals, it is difficult, in some cases, to orientate all constant-current transistors Tr.1, Tr.2 and Tr.3 in the same direction in the I/O area 202 excluding the core area 201, as can be understood from FIG. 4.

As indicated above, a matching failure occurs if the constant-current transistors are orientated in different directions. A matching failure may also take place if the constant-current transistors are laid out, each remote from any other.

BRIEF SUMMARY OF THE INVENTION

The object of the present invention is to provide a mirror circuit in which a transistor-matching failure can be prevented no matter how the transistors are laid out, thus inhibiting deterioration of the circuit characteristics and the circuit margin.

To achieve the object, a mirror circuit according to the invention comprises: a plurality of constant-current transistors; and a plurality of constant-voltage transistors. The constant-current transistors are provided removed from one another, for generating constant currents. Each of the constant-voltage transistors is provided an associated constant-current transistor located at a position, for generating a constant voltage to be applied to a gate of the associated constant-current transistor to make a source-drain current flow in the associated constant-current transistor. The source-drain current is proportional to a gate width of the associated constant-current transistor.

Another type of a mirror circuit according to the invention comprises: a plurality of constant-current transistors for generating constant currents; and a plurality of constant-voltage transistors. The constant-current transistors have source-drain paths orientated in different directions. Each constant-voltage transistor is provided for an associated constant-current transistor orientated in a direction, for generating a constant voltage to be applied to a gate of the associated constant-current transistor to make a source-drain current flow in the associated constant-current transistor. The source-drain current is proportional to a gate width of the associated constant-current transistor.

In the mirror circuits according to the invention, a constant voltage can be applied to each constant-current transistor in accordance with the direction in which the transistor is laid out or the position where the transistor is located. Thus, a source-drain current proportional to the gate width of the constant-current transistor flows in the constant-current transistor, even if it is difficult to lay out all constant-current transistors in the same direction or to arrange them close to one another. It is therefore possible to reduce the difference between the constant-current transistors in terms of threshold value and current value, which results from the different layout directions and positions of the constant-current transistors.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be described, with reference to the accompanying drawings.

Figure 5A:
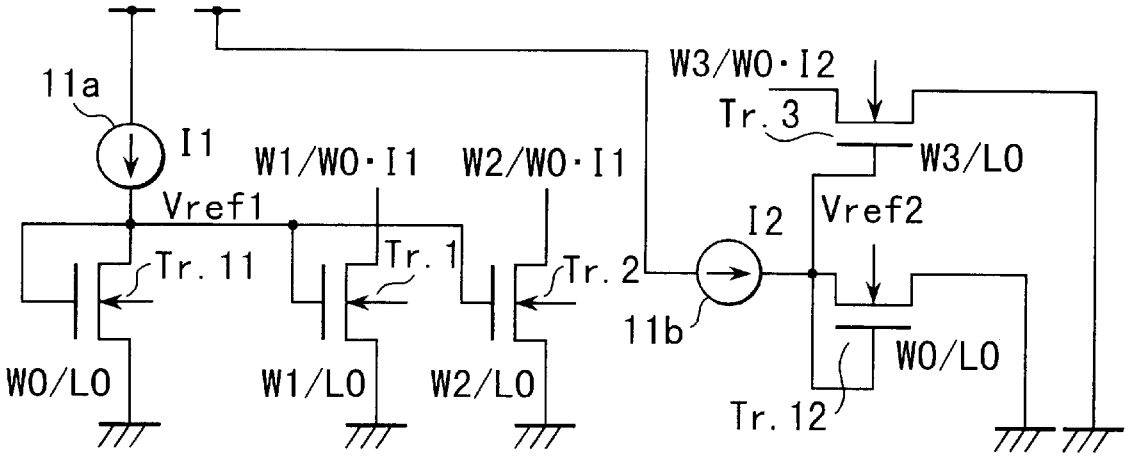
FIG. 5A is a diagram showing a mirror circuit according to one embodiment of the invention.
Figure 5B:
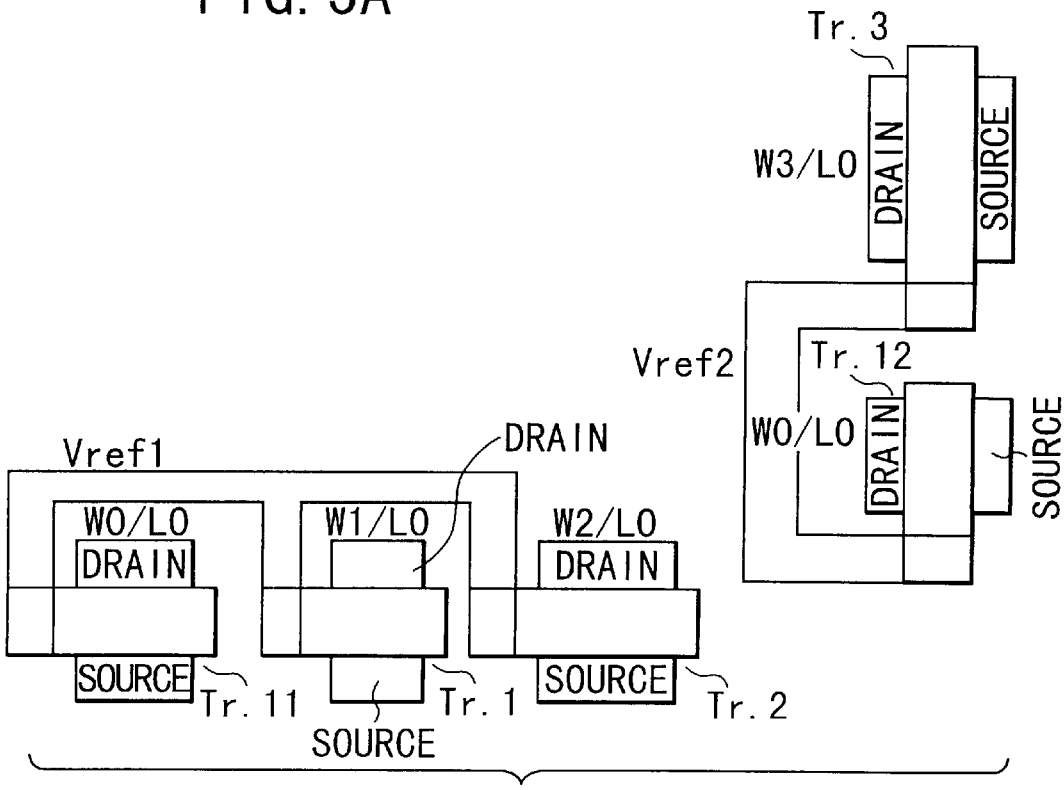
FIG. 5B is a diagram depicting the layout of the transistors in the mirror circuit shown in FIG. 5A.

FIG. 5A and 5B are a schematic representation of a mirror circuit, which is an embodiment of the present invention. More correctly, FIG. 5A is a circuit diagram, while FIG. 5B is a transistor-layout diagram of an actual circuit (e.g., a high-speed IF circuit designed for small signals).

Figure 1:
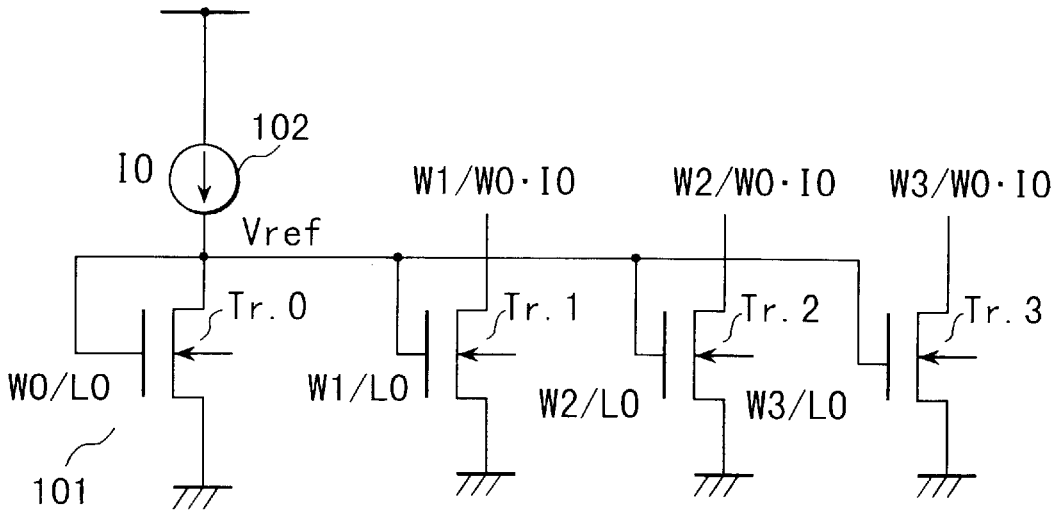
FIG. 1 (PRIOR ART)
FIG. 1 is a diagram showing a conventional mirror circuit in which all transistors are laid out in the same direction.
Figure 2:
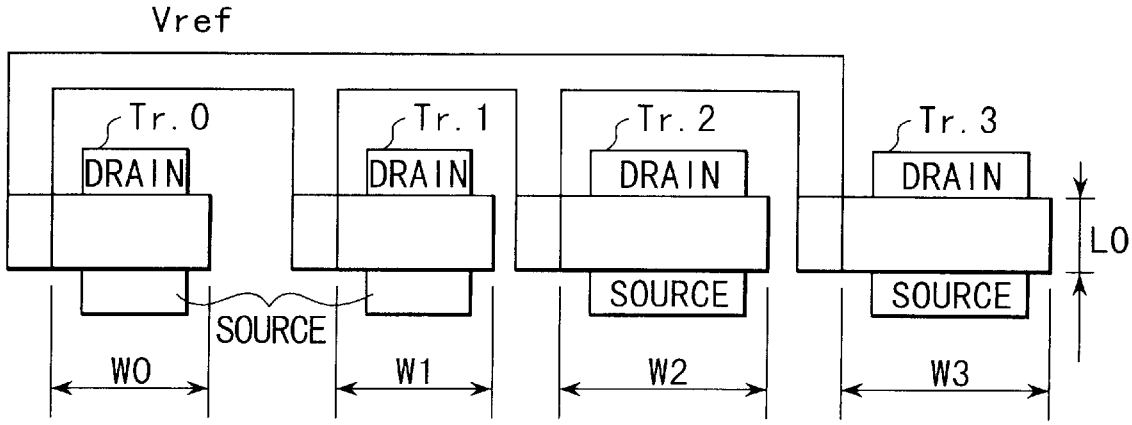
FIG. 2 (PRIOR ART)
FIG. 2 is a layout diagram of a mirror circuit in which all transistors are orientated in the same direction.
Figure 3:
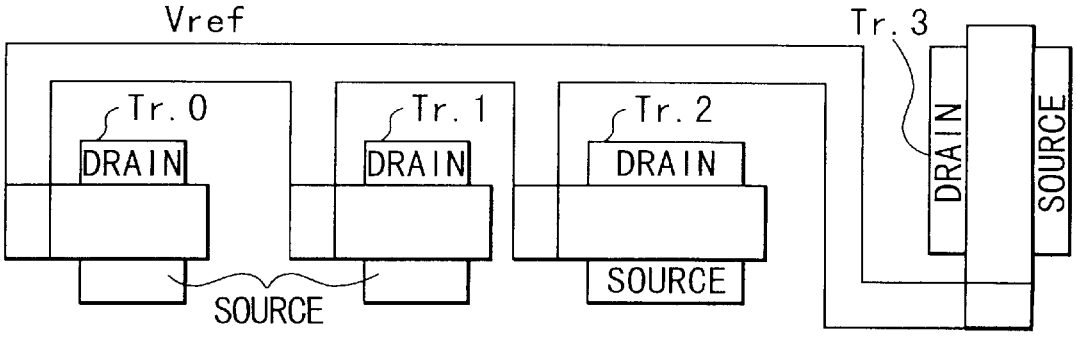
FIG. 3 (PRIOR ART)
FIG. 3 is a layout diagram of a mirror circuit in which all transistors, except one, are orientated in the same direction.
Figure 4:
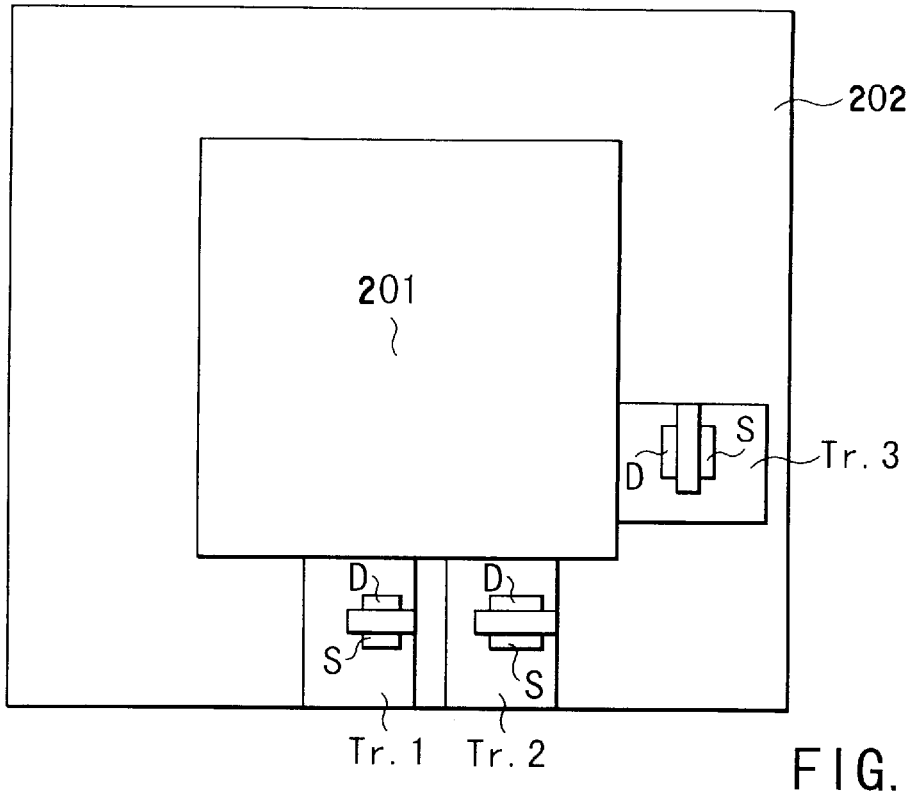
FIG. 4 (PRIOR ART)
FIG. 4 is a plan view illustrating the layout of the constant-current transistors in an actual mirror circuit.

As shown in FIG. 4, three N-channel MOS transistors (constant-current transistors) Tr.1, Tr.2 and Tr.3 are arranged in the I/O area of the actual circuit. These transistors Tr.1, Tr.2 and Tr.3 are designed to generate constant currents. In each of the constant-current transistors Tr.1, Tr.2 and Tr.3 there flows a source-drain current (a constant current) which is proportional to the gate width of the transistor. Of the three N-channel MOS transistors, the transistors Tr.1 and Tr.2 have their source-drain paths orientated in the same direction and are located close to each other. The transistor Tr.3 has its source-drain path extending at right angles to the source-drain paths of the transistors Tr.1 and Tr.2 (That is, the source-drain path of the transistor Tr.3 is orientated in a direction that is different from the orientation direction of the source-drain paths of the transistors Tr.1 and Tr.2.). The transistor Tr.3 is located somewhat remote from the transistors Tr.1 and Tr.2.

An N-channel MOS transistor (constant-voltage transistor) Tr.11 for generating a constant voltage is provided in the vicinity of the constant-current transistors Tr.1 and Tr.2. The constant-voltage transistor Tr.11 receives a constant current I1 from a constant current circuit 11*a* (or an external terminal, not shown) and generates a constant bias voltage (constant voltage Vref1). The constant bias voltage Vref1 is applied to the gates of the constant-current transistors Tr.1 and Tr.2. The constant-voltage transistor Tr.11 is laid out in the same direction as the constant-current transistors Tr.1 and Tr.2.

An N-channel MOS transistor (constant-voltage transistor) Tr.12 for generating a constant voltage is provided in the vicinity of the constant-current transistor Tr.3. The constant-voltage transistor Tr.12 receives a constant current I2 from a constant current circuit 11*b* (or an external terminal, not shown) and generates a constant bias voltage (constant voltage Vref2). The constant bias voltage Vref2 is applied to the gate of the constant-current transistor Tr.3. The constant-voltage transistor Tr.12 has a silicon gate, and the silicon gate is designed so as to have the same width (W) and length (L) as those of the silicon gate of the constant-current transistor Tr.11. The constant-voltage transistor Tr.12 is laid out in the same direction as the constant-current transistor Tr.3. In other words, the transistor Tr.12 extends at right angles to the constant-voltage transistor Tr.11.

The silicon gates of the transistors Tr.11, Tr.12, Tr.1, Tr.2 and Tr.3 are designed so as to have the same length (L0). The transistors Tr.11, Tr.12, Tr.1, Tr.2 and Tr.3 have different gate widths W0, W0, W1, W2 and W3, respectively. The transistors Tr.11, Tr.12, Tr.1, Tr.2 and Tr.3 have their source diffusion layers connected to the same terminal (e.g., ground potential).

In the mirror circuit of FIG. 5A, the constant-current transistors Tr.1 and Tr.2 have their source-drain paths extending in the same direction as the source-drain path of the constant-voltage transistor Tr.11. Hence, the current values of the constant-current transistors Tr.1 and Tr.2 (i.e., W1/W0×I1 and W2/W0×I1) are determined by the ratios (W ratios) of their gate widths to the gate width of the constant-voltage transistor Tr.11. The constant-current transistor Tr.3 has its source-drain path extending in the same direction as the source-drain path of the constant-voltage transistor Tr.12. The current value of the constant-current transistors Tr.3 (i.e., W3/W0 ×I2) is therefore determined by the ratio (W ratio) of its gate width to the gate width of the constant-voltage transistor Tr.12.

Thus, the constant currents I1 and I2 act as mirror currents if these currents supplied to the constant-voltage transistors Tr.11 and Tr.12, respectively, are equal to each other. In this case, a mirror current flows in the transistors Tr.11, Tr.1 and Tr.2, and a mirror current flows in the transistors Tr.12 and Tr.3, too. The current values of the constant-current transistors Tr.1, Tr.2 and Tr.3 are determined by their respective gate-width ratios alone. As a result, no transistor-matching failure occurs, though the constant-current transistor Tr.3 is laid out remote from, and orientated in a different direction from, the constant-current transistors Tr.1 and Tr.2.

Figure 6:
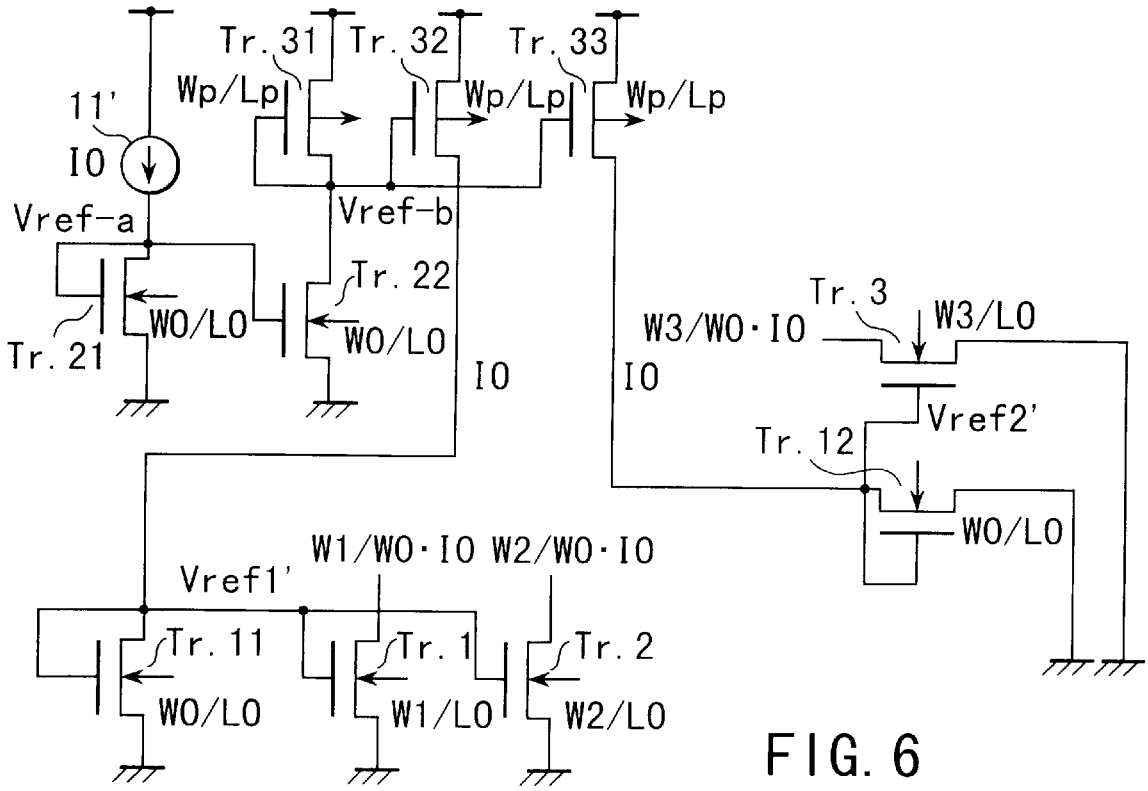
FIG. 6 is a diagram illustrating a mirror circuit according to another embodiment of the invention, in which the same constant current is supplied to all constant-voltage generating transistors.

FIG. 6 shows a mirror circuit, another embodiment of the invention, in which the same constant current I0 is supplied to all constant-voltage transistors Tr.11 and Tr.12.

This mirror circuit comprises, for example, two N-channel MOS transistors Tr.21 and Tr.22 and three P-channel MOS transistors Tr.31, Tr.32 and Tr.33, as well as transistors Tr.1, Tr.2, Tr.3, Tr.11 and Tr.12. The transistors Tr.21, Tr.22, Tr.31, Tr.32 and Tr.33 are provided between a constant-current circuit 11', on the one hand, and the constant-voltage transistors Tr.11 and Tr.12, on the other. The N-channel MOS transistors Tr.21 and Tr.22 have a gate width W0 and a gate length L0. The P-channel MOS transistors Tr.31, Tr.32 and Tr.33 have a gate width Wp and a gate length Lp.

The constant-current circuit 11', supplies a constant current I0 to the gate and drain of the N-channel MOS transistor Tr.21. The transistor Tr.21 generates a constant voltage Vref-a. The constant voltage Vref-a is applied to the gate of the N-channel MOS transistor Tr.22. The constant current I0 therefore flows in the transistor Tr.22. The current I0 flowing in the transistor Tr.22 is supplied, as a drain current, to the gate and drain of the P-channel MOS transistor Tr.31. The constant current I0 flows in the transistor Tr.31. The transistor Tr.31 generates a constant voltage Vref-b that depends on the dimensional value of Wp/Wp. This constant voltage Vref-b makes the constant current I0 flow in the P-channel MOS transistors Tr.32 and Tr.33. The constant voltage Verf-b is applied to the gates of the P-channel MOS transistors Tr.32 and Tr.33. As a result, the constant current I0 flows in the transistors Tr.32 and Tr.33. The constant current I0 is supplied through the drains of the P-channel MOS transistor Tr.32 to the gate and drain of the N-channel MOS transistor Tr.11. Meanwhile, the constant current I0 flowing in the P-channel MOS transistor Tr.33 is supplied to the gate and drain of the N-channel MOS transistor Tr.12.

The sources of the transistors Tr.21 and Tr.22 are connected to the same terminal (e.g., ground potential), like the transistors Tr.11, Tr.12, Tr.1, Tr.2 and Tr.3.

In the mirror circuit that has the structure of FIG. 6, the constant voltages Vref1', and Vref2' the N-channel MOS transistors Tr.11 and Tr.12 have generated are equal to each other. The constant current I0 is therefore matched well. This can help to enhance the precision of transistor matching.

As has been indicated above, a constant voltage is generated in accordance with the position and direction in which each constant-current transistor is laid out. The constant voltage thus generated causes a source-drain current to flow in the constant-current transistor, which is proportional to the gate width of the constant-current transistor. In other words, constant voltage is generated in accordance with the position and direction in which each constant-current transistor and is applied to the gate terminal of the constant-current transistor. A constant current, which is matched well, is thereby supplied to each constant-current transistor. The difference between the constant-current transistors in terms of threshold value and current value, which results from the different layout directions and positions (i.e., inter-transistor distances) of the constant-current transistors, can therefore be more reduced than in the case where the same voltage is supplied to all constant-current transistors. As a result, a transistor-matching failure can be prevented, regardless of the layout of the transistors.

In the embodiments described above, the constant-current transistors are different in dimensions. Nevertheless, this invention can be applied to a mirror current in which all transistors are of the same dimensions.

As has been described in detail, a constant current, already matched well, can be supplied to each transistor in the present invention. A failure in the matching of transistors can therefore be prevented, irrespective of the layout of the transistors. The invention can provide a mirror circuit in which it is possible to inhibit the circuit characteristics and the circuit margin from deteriorating, even if all constant-current transistors can hardly be orientated in the same direction or laid out close to one another.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A mirror circuit comprising:

a plurality of constant-current transistors for generating constant currents, wherein said constant-current transistors include a transistor located at a first position and a transistor located at a second position which is separated from the first position by a predetermined distance;

a plurality of constant-voltage transistors, each provided at an associated constant-current transistor, for generating a constant voltage to be applied to a gate of the associated constant-current transistor to make a source-drain current flow in the associated constant-current transistor, said source-drain current being proportional to a gate width of the associated constant-current transistor; and a current-supplying circuit provided between the constant-current transistors and a constant-current circuit, wherein the current supplying circuit supplies a constant-current from the constant-current circuit to the constant-voltage transistors, wherein said plurality of constant-voltage transistors are located close to the constant-current transistors and laid out in an identical direction to that of the constant-current transistors.

2. A mirror circuit according to claim 1, wherein each constant-voltage transistor has a source-drain path oriented in the same direction as a source-drain path of the associated constant-current transistor.

3. A mirror circuit according to claim 1, wherein the constant-current transistors and the constant-voltage transistors have the same gate length.

4. A mirror circuit according to claim 1, wherein the constant-current transistors differ in dimensions.

5. A mirror circuit according to claim 1, wherein the constant-current transistors are identical in dimensions.

6. A mirror circuit according to claim 1, wherein the current-supplying circuit supplies the same constant current to the constant-voltage transistors.

7. A mirror circuit comprising:

a plurality of constant-current transistors having source-drain paths laid out in different directions;

a plurality of constant-voltage transistors, each provided for an associated constant-current transistor, for generating a constant voltage to be applied to a gate of the associated constant-current transistor to make a source-drain current flow in the associated constant-current transistor, said source-drain current being proportional to a gate width of the associated constant-current transistor; and a current-supplying circuit provided between the constant-current transistors, on the one hand, and a constant-current circuit, on the other hand, for supplying a constant current from the constant-current circuit to the constant-voltage transistors, wherein said plurality of constant-voltage transistors are located close to the constant-current transistors and laid out in an identical direction to that of the constant-current transistors.

8. A mirror circuit according to claim 7, wherein each constant-voltage transistor has a source-drain path orientated in the same direction as a source-drain path of the associated constant-current transistor.

9. A mirror circuit according to claim 7, wherein the constant-current transistors and the constant-voltage transistors have the same gate length.

10. A mirror circuit according to claim 7, wherein the constant-current transistors differ in dimensions.

11. A mirror circuit according to claim 7, wherein the constant-current transistors are identical in dimensions.

12. A mirror circuit according to claim 7, wherein the current-supplying circuit supplies the same constant current to the constant-voltage transistors.

13. A mirror circuit according to claim 6, wherein the current-supplying circuit comprises two N-channel MOS transistors having source-drain paths oriented in the same direction and three P-channel MOS transistors having source-drain paths oriented in the same direction.

14. A mirror circuit according to claim 12, wherein the current-supplying circuit comprises two N-channel MOS transistors having source-drain paths oriented in the same direction and three P-channel MOS transistors having source-drain paths oriented in the same direction.

* * * * *